US006694757B1

(12) United States Patent
Backman

(10) Patent No.: US 6,694,757 B1
(45) Date of Patent: Feb. 24, 2004

(54) MULTIPLE STAGE DEHUMIDIFICATION AND COOLING SYSTEM

(76) Inventor: Thomas J. Backman, 4915 Arendell St., #313, Morehead City, NC (US) 28557

( * ) Notice: Subject to any disclaimer, the term of this patent is extended or adjusted under 35 U.S.C. 154(b) by 0 days.

(21) Appl. No.: 10/372,529

(22) Filed: Feb. 21, 2003

Related U.S. Application Data

(60) Provisional application No. 60/358,685, filed on Feb. 21, 2002.

(51) Int. Cl.[7] ..... F25B 29/00
(52) U.S. Cl. ..... 62/173; 62/176.6
(58) Field of Search ..... 62/173, 176.6, 62/90, 175, 201, 150; 236/91 C

(56) References Cited

U.S. PATENT DOCUMENTS 3,012,411 A * 12/1961 Kjellman ..... 62/173
5,172,565 A * 12/1992 Wruck et al. ..... 62/177
5,400,607 A * 3/1995 Cayce ..... 62/90
5,493,871 A * 2/1996 Eiermann ..... 62/173
5,884,492 A * 3/1999 Zwicky et al. ..... 62/91
5,992,161 A * 11/1999 O'Halloran et al. ..... 62/90

* cited by examiner

*Primary Examiner*—Marc Norman

(57) ABSTRACT

A multiple stage dehumidification and cooling system wherein a first stage direct expansion dehumidifier operating at its optimum dew point to an entering high humidity, high temperature air stream and effecting a first lowering of the temperature and humidity of the air stream, with the conditioned air stream being serially conveyed to a second stage chilled liquid dehumidifier operating at its optimum dew point to effect a second lowering of the temperature and humidity, and thereafter to a third stage reheat coil for providing an exiting air stream of desired temperature and humidity conditioning. The synergistic coupling provides significant power saving over the prior alternatives of desiccant and chilled liquid systems and the stages are individually modulated to reduce power consumptions as the load temperature and humidity set points are approached.

7 Claims, 2 Drawing Sheets

MULTIPLE STAGE DEHUMIDIFICATION AND COOLING SYSTEM

RELATED APPLICATION

This application claims the benefit under 35 USC 121 of United States Provisional Application No. 60/358,685 filed on Feb. 21, 2002 in the name of Thomas J. Backman and entitled "Hybrid Dehumidifier and Cooling System.

FIELD OF THE INVENTION

The present invention relates to apparatus for cooling apparatus and, in particular to a dehumidification and cooling system employing synergistic effects of serially coupled direct expansion ("DX") and liquid chilling to achieve low air stream dew points with low power consumption under conditions of high moisture loads.

BACKGROUND OF THE INVENTION

The cooling systems commercial and retail facilities generally include a remotely located primary unit that is individually connected to various cooling loads or zones, such as air conditioning. Chilled liquid or direct expansion cooling systems are typically used.

Evolving standards and regulations are requiring increased outdoor air introduction into commercial and industrial buildings for improving interior air quality. Introducing such outdoor air: into areas having stringent humidity control requirements can greatly increase of dehumidification removal load requirements, particularly during periods of increased temperature and humidity. Humidity sensitive environments such as supermarkets, libraries, sports arenas, hotels, food storage, and process control areas can suffer severe adverse operational problems, from mold, mildew, and product and equipment damage if the cooling systems cannot handle the increased moisture. To adequately handle moisture removal in such situations, it has been widely accepted that an internal dew point temperature of 50° F. or less is required in these spaces, and that the supply air accordingly must be about 40° F. At such lowered temperature, traditional direct expansion dehumidifiers are prone to icing, and supplemental defrost systems are required. The additional costs associated with the defrost systems and the attendant operational problems have reduced the use of direct expansion dehumidification systems in these humidity dependent applications.

The lower dew points can be achieved without defrost cycles using chilled liquid systems, enabling operational dew points as low as about 34° F. Sophisticated controls systems, however, are required and the power consumption is greater than the direct expansion systems. Alternatively, desiccant dehumidifiers may be used to achieve these requisite dew point conditions, but only at high operational and maintenance costs.

BRIEF SUMMARY OF THE INVENTION

The present invention provides a multiple stage dehumidification and cooling system wherein a first stage direct expansion dehumidifier operating at its optimum dew point to an entering high humidity, high temperature air stream and effecting a first lowering of the temperature and humidity of the air stream, with the conditioned air stream being serially conveyed to a second stage chilled liquid dehumidifier operating at its optimum dew point and effecting a second lowering of the temperature and humidity, and thereafter to a third stage reheat coil for providing an exiting air stream of desired temperature and humidity conditioning. The synergistic coupling provides significant power saving over the prior alternatives of desiccant and chilled liquid systems. Further, the stages are individually modulated to reduce power consumptions as the load temperature and humidity set points are approached.

DESCRIPTION OF THE DRAWINGS

The above and other objects and advantages of the invention will become apparent upon reading the following written description taken in conjunction with the accompanying drawings in which.

DETAILED DESCRIPTION OF THE PREFERRED EMBODIMENTS

Figure 1:
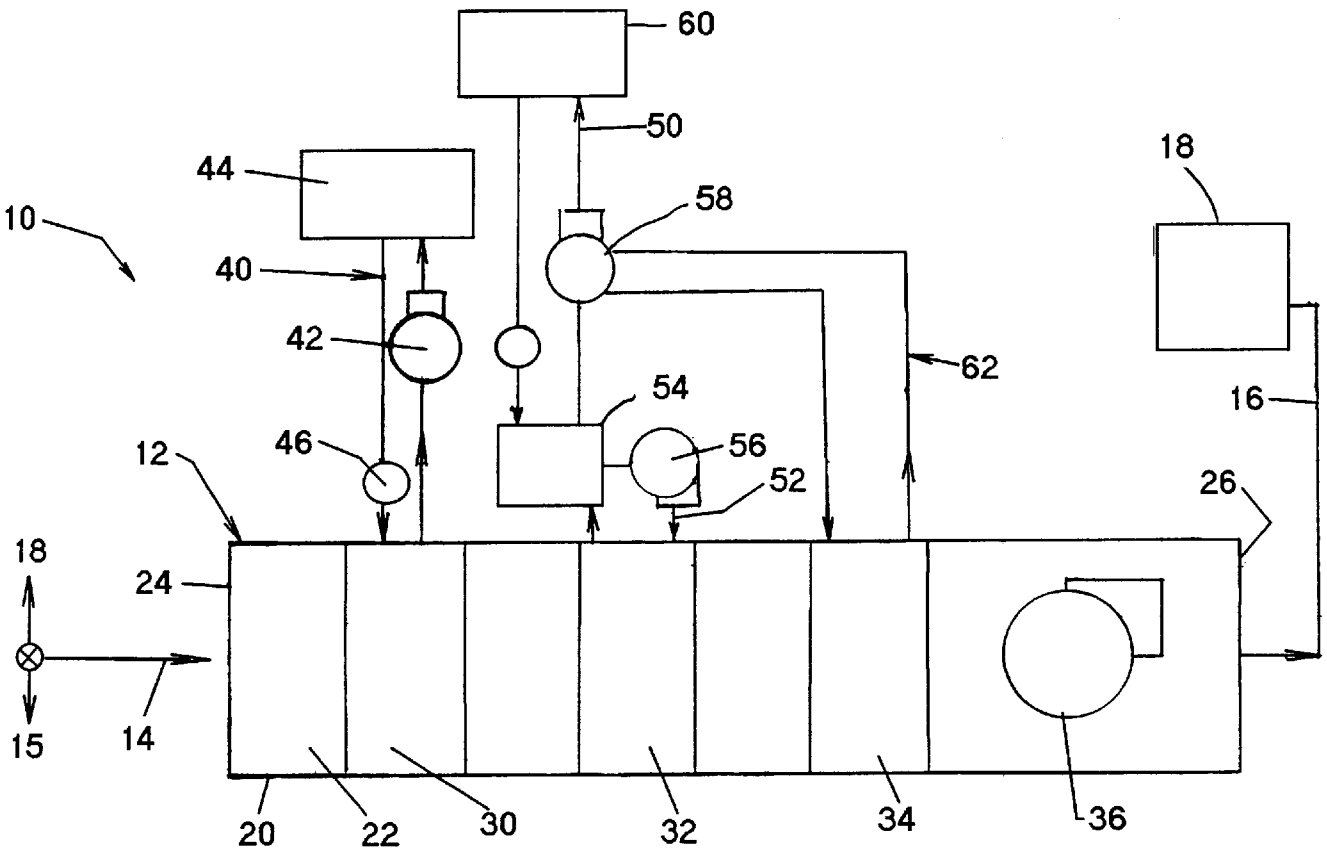
FIG. 1 is a block diagram of the mechanical components for the multiple stage dehumidification system in accordance with a preferred embodiment of the invention.

Referring to the drawings for the purpose of illustrating a preferred embodiment of the invention and not for limiting same, FIG. 1 shows a multiple stage dehumidification and cooling system 10 including an air handler 12 for receiving an input air stream 14, from interior and/or exterior sources and at variable temperature and humidity conditions, and delivering an output air stream 16 for routing to an environmental load 18 to establish and maintain predetermined temperature and humidity conditions thereat. The system may operate as freestanding units for cooling and dehumidification requirements, or as a secondary unit for handling extreme environmental conditions.

The air handler 12 comprises a housing 20 defining an internal fluid passage 22 having an inlet 24 fluidly coupled with the inlet stream 14 and an outlet 26 fluidly coupled with the output stream 16. Serially disposed in the passage 22 downstream of the inlet 24 are a direct expansion heat transfer coil 30, a chilled liquid heat transfer coil 32, a reheat coil 34 and a delivery fan 36. The housing is provided with a drain 37 for removing condensed moisture.

The inlet stream 14 may be furnished from the load 18 and/or outside air 15 through conventional valving 17. The system as hereinafter described has particular application in situations wherein regulations or other consideration require substantial quantities of outside air that may further increase the system demands.

The direct expansion heat transfer coil 30 is disposed in a direct expansion thermal cooling loop 40 serially connected in the direction indicated by the arrows to a compressor 42, a condenser 44 and an expansion control valve 46. The components for the loop 40 are well known in the art and sized and selected in accordance with the requirements of the load. The loop 40 employs any suitable direct expansion refrigerant, for example R-22, or a refrigerant on the list hereinafter set forth.

The liquid heat transfer coil 32 is connected in a plural stage loop comprising a primary loop 50 and a secondary loop 52. The coil 32 is disposed in the secondary loop 52 and serially connected in the direction indicated by the arrows to a liquid chiller 54 and a liquid pump 56. The liquid chiller 54 is also connected in the primary loop 50 serially with a compressor 58 and a condenser 60. The loops 50 and 52 employ any suitable liquid refrigerant, for example glycol, or accepted refrigerants on the list hereinafter set forth.

The reheat coil 34 is serially connected in a reheat loop 62 with any suitable source providing suitable heating capacity, such as the waste lines of the liquid compressor 54.

The above coils 30 and 32 are heat transfer systems for lowering the air stream to a temperature below the dew point. The lowest mean temperature reached is called the air dew point temperature. During cooling, water vapor condenses on coil fins and the liquid routed to liquid drain. Exiting the coils, the air stream is cold and saturated (100% relative humidity) with water. Thereafter, heat is introduced to the air stream at the reheat coil to increase the air temperature with a resultant lowered humidity.

Direct expansion cooling coils are more energy efficient in dehumidifiers than chilled liquid cooling coils because the heat transfer is effected in a direct primary loop and does not require the secondary loop, including an additional heat exchanger and a direct expansion system which have incremental power consumptions.

When operating a dehumidifier, the system is designed to keep the coil temperature above 32° F. at all times to avoid forming on the cooling coil and blocking the airflow therethrough. This is achieved by operating the cooling coils at a gradient of about 10° F. below the exit temperature of the air. Additionally, a fluctuation safety factor of about 4° F. is incorporation such that that DX dehumidifiers typically have a minimum threshold air temperature of 46° F. establishing the minimum moisture level in the air stream exiting the expansion coil, hereinafter DX optimum operating dew point.

Most chilled liquid cooling coils are designed with about a 1° F. temperature gradient and a 1° F. fluctuation safety factor thereby establishing a minimum exit temperature from cooling coils of about 34° F. or CL optimum operating dew point. The actual operating optimum dew points may vary slightly based on manufacture and design, but each will have an accepted operational temperature that prevents freezing and icing experiences. It will thus be appreciated that while the chilled liquid coil is less efficient than a DX coil, it can create much lower humidity that DX coils.

The foregoing design and control of the present system synergistically takes advantage of the high efficiency of DX cooling in conjunction with the low dew point of chilled liquid cooling. As hereinafter described, the DX coil cools the air stream to 46° F. serially followed by the chilled liquid coil cooling the air stream further to a temperature of 34° F. Reheat as required delivers an efficiently dehumidified air supply to high demand spaces. The individual stages are controlled to provide progress power reductions for the overall system as the load approaches humidity and temperature set points.

The two cooling systems in serial air stream arrangement achieve cooling and dehumidification in a combination of low power consumption with low dehumidification dew point that cannot be achieved with either direct expansion systems or liquid secondary cooling systems operating alone. The system takes advantage of the high dehumidification capabilities of both systems.

Figure 2:
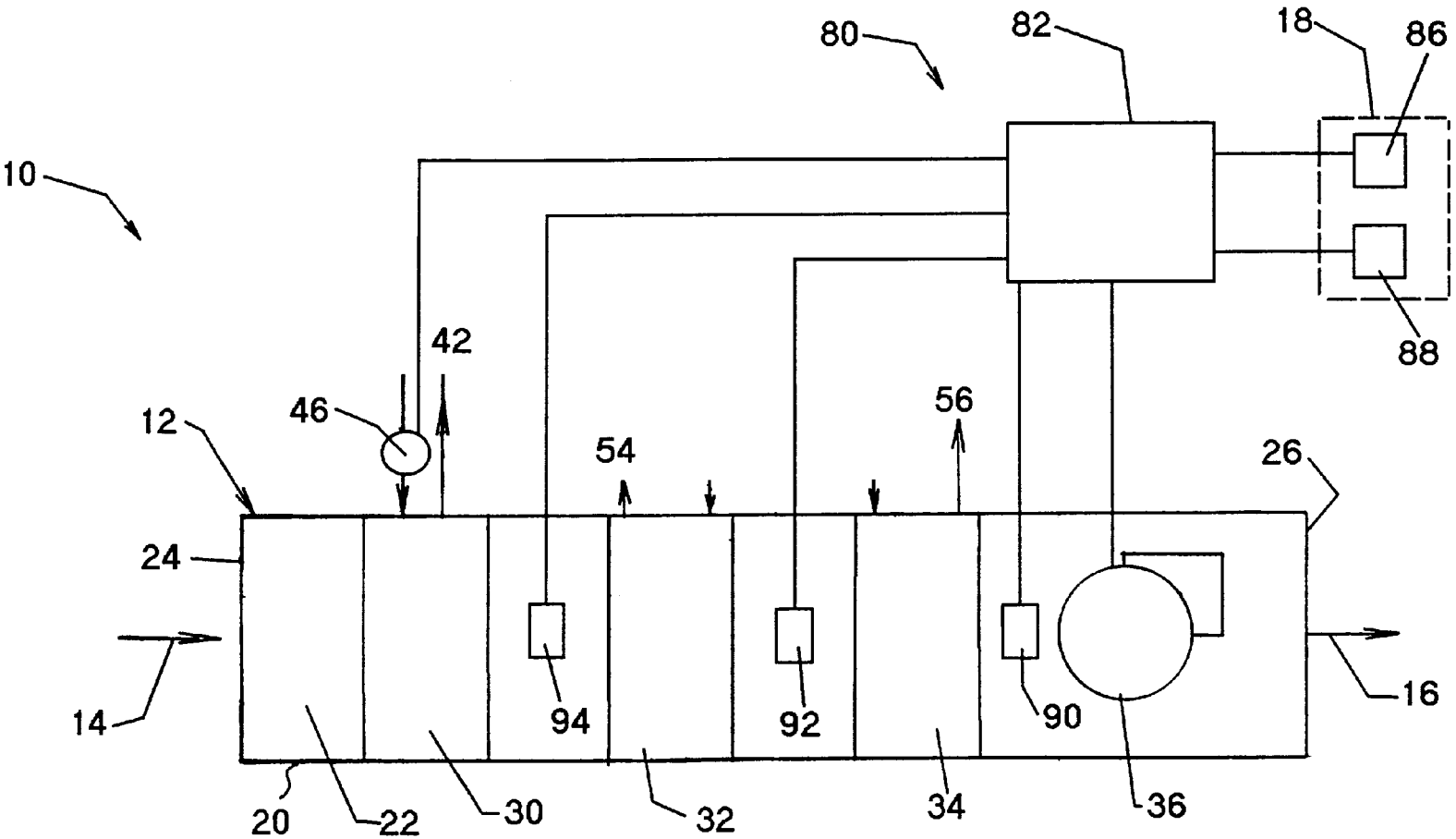
FIG. 2 is a block diagram of the dehumidification system including the control system.

Referring to FIG. 2, the control system 80 for the dehumidification system 10 comprises a process controller 82 that determines local conditions at the load 84 with a load temperature sensor 86 and a load humidity sensor 88. The controller 82 is interfaced with a waste coil temperature sensor 90 downstream of the reheat coil 42, a chilled coil temperature sensor 92 downstream of the chilled coils 44, and an expansion coil sensor 94 downstream of the expansion coil 46. The controller 80 is further interfaced with the variable speed fan 48 and the expansion valve 62 in the expansion loop 40.

During an "unoccupied mode", the system 10 is disabled through an appropriate command at the controller 80. When the system is enabled, the prevailing conditions at the load 18 are determined by the temperature sensor 82 and the humidity sensor 84. If either is outside the set points, the fan 48 is operated to draw the air stream through the air handler. Thereafter, if the temperature sensor 84 is low, the reheat coil 48 is energized to control the exit air temperature from the reheat coil at the target temperature. If the load temperature is within limits, the reheat coil remains disabled. If the humidity is above the set point at the load humidity sensor 84, the chilled liquid system is enabled if the exit temperature sensed by sensor 90 is above the CL optimum dew point temperature. If the exit temperature is below the threshold value, the chilled liquid system remains disabled. After stabilization of the chilled liquid system, the controller 80 polls the expansion coil sensor 44. If the exit temperature is above the DX optimum dew point temperature value, the expansion system is enabled. If below, the expansion system remains disabled. In this fully operating mode, the dehumidification is handled predominantly by the direct expansion stage.

Under operating conditions, as the load humidity approaches set point, the expansion valve 46 is progressive throttled to maintain the optimum dew point temperature value at the transient lower demand, which would otherwise result in an excursion therebelow and icing of the coils. Under further reductions, the expansion valve is further throttled until closed resulting in progressive power savings, and the controller disables the expansion system. Thereat, the residual humidity load is handled by the chilled liquid system. Upon further humidity decreases in the inlet air, the controller 82 decreases the speed of the fan to decrease flow rate through the handler 14 while maintaining the CL optimum dew point temperature value and progressively continuing until the set point humidity at the load is attained. For subsequent operational transient, the control sequences are reversely adopted. As a result, the phased dual mode humidification provides humidity control without reheat or evaporation modalities, allows for capital downsizing of single mode systems and importantly reduces operating costs in comparison with the now single phase chilled liquid cooling or desiccant removal as exemplified by the following conditions:

EXAMPLE 1

A 1,000 scfm stream of air at 95° F. and 100% relative humidity is to be dehumidified to a 34° F. dew point. Such conditions are representative of extreme summer conditions in southern climates.

DX Cooling System ("DX"): A DX cooling coil cannot be used as the sole system for such conditions inasmuch as the coil will accumulate ice and airflow will decrease until stopping completely.

Chilled Liquid Cooling System ("CL"): It is assumed that the liquid is chilled by a direct expansion system in the primary loop having a saturated suction temp of 20° F. at the heat exchanger. The chilled cooling liquid leaves the heat exchanger at 30° F. The 95° F. entering air leaves the cooling coil at 34° F. Total cooling load would be 228,402 BTU/hr. Refrigeration compressor power consumption according to accepted practice is 27.6 kW.

Multiple Stage Dehumidification and Cooling System ("MS")

Stage 1, direct expansion cooling coil saturated suction temp=36° F. at the cooling coil. The 95° F. entering air leaves the expansion cooling coil at 46° F. Subtotal cooling load is 203,306 BTU/hr. Subtotal Refrigeration compressor power consumption is 18.9 kW.

Stage 2, the expansion cooling coil in primary loop is operated at a saturated suction temp of 20° F. at the heat exchanger. The chilled cooling liquid leaves the heat exchanger at 30° F. The 46° F. entering air leaves the coil at 34° F. Total cooling load is 25,097 BTU/hr. Subtotal refrigeration compressor power consumption is 3.8 kW.

Total cooling=203,306+25,096=228,402 BTU/hr. Total refrigeration compressor power consumption is 3.8+18.9 or 22.7 kW.

Comparison:

| | DX | CL | MS | % reduction |
|---|---|---|---|---|
| Cooling-Btu/hr | N/A | 228,402 | 228,402 | 0 |
| Compressor kW | N/A | 27.6 | 22.7 | 8.2 |
| Pumping kW | N/A | 1.9 | 0.2 | 89.5 |
| Total KW | N/A | 29.8 | 22.9 | 30.3 |

In this example, the chilled water system total kW is 27.9+1.9=29.8 kW. The new Hybrid system hybrid system total kW is 22.7+.2=22.9 kW. The chilled liquid system power consumption is 30.3% higher than the multiple mode system of the invention.

EXAMPLE 2

A 1,000 scfm stream of air at 95° F. dry bulb and 740 F. at 950 wet bulb to be dehumidified to a 340 F. dew point. This condition is representative of southeastern design conditions.

DX cooling system: A DX cooling coil cannot be used inasmuch as the coil will accumulate ice and airflow will decrease until stopping completely.

Chilled liquid cooling System: Assume that the liquid is chilled by a direct expansion system in the primary loop having a saturated suction temp of 20° F. at the heat exchanger. The chilled cooling liquid leaves the heat exchanger at 30° F. The 95°0 F. entering air leaves the cooling coil at 34° F. Total cooling load is 112,089 BTU/hr. Refrigeration compressor power consumption according to accepted practice is 13.7 kW and 1.9 kW pumping power.

Desiccant Dehumidifier ("DS"). The desiccant system heats the entering air to 138° F. The regeneration air stream is 148° F. or ten degrees above final supply air temperature. An expansion coil is use to cool the air stream 53° requires 57,240 BTU/hr or 16.8 kW. Post cooling compressor power consumption is 7.0 kW. Total required power for the desiccant system is 23.8 kW.

Multiple Stage Dehumidification System

Stage 1, direct expansion cooling coil saturated suction temp=36° F. at the cooling coil. The 95° F. entering air leaves the expansion cooling coil at 46° F. Subtotal cooling load is 87,044 BTU/hr. Subtotal Refrigeration compressor power consumption is 7.8 kW kW.

Stage 2, Expansion cooling coil in primary loop operates at a saturated suction temp of 20° F. at the heat exchanger. The chilled cooling liquid leaves the heat exchanger at 30° F. The 46° F. entering air leaves the coil at 34° F. Total cooling load=25,045 BTU/hr. Subtotal Refrigeration compressor power consumption=3.2. kW.

Total cooling=87,044+25,045=112,089 BTU/hr Total Refrigeration compressor power consumption=11.0 kW. Pumping power is 0.2 kW.

Comparison:

| | Ds | CL | MS |
|---|---|---|---|
| Cooling BTU/hr | 144,172 | 112,089 | 112,089 |
| Power kW | 23.8 | 13.7 | 11.02 |
| Pumping KW | 0 | 1.9 | 0.2 |
| Total kW | 23.8 | 15.6 | 11.2 |

In this example, the chilled water system total kW is 39% higher than the system of the present invention. The desiccant power consumption is 212% higher than the present invention.

Other Fluids for the Dehumidification and Cooling System

Commonly used refrigeration or heat transfer fluids would be suitable for the secondary liquid system. Some of these include, but are not limited to: glycol solutions, propylene glycol, ethylene glycol, brines, inorganic salt solutions, potassium solutions, potassium formiate, silicone plymers, synthetic organic fluids, eutectic solutions, organic salt solutions, citrus terpenes, hydrofluouroethers, hydrocarbons, chlorine compounds, methanes, ethanes, butane, propanes, pentanes, alcohols, diphenyl oxide, biphenyl oxide, aryl ethers, terphenyls, azeotropic blends, diphenylethane, alkylated aromatics, methyl formate, polydimethylsiloxane, cyclic organic compounds, zerotropic blends, methyl amine, ethyl amine, ammonia, carbon dioxide, hydrogen, helium, water, neon, nitrogen, oxygen, argon, nitrous oxide, sulfur dioxide, vinyl chloride, propylene, R400, R401A, R402B, R401C, R402A, R402B, R403A, R403B, R404A, R405A, R406A, R407A, R407B, R407C, R407D, R408A, R409A, R409B, R410A, R410B, R411A, R411B, R412A, R500, R502, R503, R504, R505, R506, R507A, R508A, R508B, R509A, R600A, R1150, R111, R113, R114, R12, R22, R13, R116, R124, R124A, R125, R134A, R143A, R152A, R170, R610, R611, sulfur compounds, R12B1, $R12B_2$, R13B1, R14, R22B1, R23, R32, R41, R114, R1132A, R1141, R1150, R1270, fluorocarbons, carbon dioxide, solutions of water, an d combinations of the above fluids.

Other Advantages

There is a power cost savings associated with utilizing compressor power consumption to cool a thermal bank on electrical power utility off peak hours. The thermal storage design typically requires a primary refrigeration system operating in a primary loop and carrying a primary refrigerant; a liquid secondary refrigeration system operating in a secondary loop and carrying a secondary liquid refrigerant; heat transfer means for transferring heat from said secondary loop to said primary loop; a secondary cooling coil that is cooled by the secondary loop. In this new invention a similar coil is located in serial air stream association with a first direct expansion cooling coil. With the expenditure of the secondary liquid cooling coil previously financially justified by the serial air stream dehumidification design, thermal energy storage systems enjoy a shorter financial payback time period because the cost of the secondary cooling coil is not applied to the thermal storage system cost.

Additionally, this new invention allows the flexibility of operating a cooling or dehumidification system in the primary direct expansion mode, in the secondary liquid cooling mode, or in both modes at once. This feature removes some of the operational risk from thermal energy storage systems by reducing the risk of operational failure during an energy storage capacity failure. This feature removes some of the operational risk from direct expansion primary cooling systems by reducing the risk of operational failure during a compressor failure.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A method for cooling and dehumidifying an cooling and humidifying area to selected temperature and humidity values, said method comprising the steps of:

routing an entering air stream including at least a portion from said air to an air handling device having a flow passage therethrough including an inlet for receiving an inlet air stream including at least a portion from said load and an outlet for discharging an outlet air stream to said load; providing a direct expansion cooling loop having a direct expansion cooling coil disposed in said flow passage adjacent said inlet for routing said inlet air stream therethrough, operating said expansion cooling coil to provide an expansion optimum dew point operating temperature for the exiting air stream from said direct expansion cooling coil above which icing on said direct expansion cooling coil is prevented; providing a chilled liquid cooling loop having a chilled liquid cooling coil in said flow passage downstream of said expansion cooling coil and receiving the exiting air stream therefrom; operating said chilled liquid cooling coil at a chilled liquid optimum dew point operating temperature for the exiting air stream from said liquid cooling coil above which icing on said chilled liquid cooling coil is prevented; and reheating the air stream exiting said chilled liquid cooling coils to raise the temperature thereof; and delivering a dehumidified and conditioned air stream through said outlet to said load.

2. A cooling and dehumidification system for controlling the humidity in a cooling and dehumidification load to be conditioned to selected temperature and humidity values, said system comprising: air handling means having a flow passage therethrough including an inlet for receiving an inlet air stream including at least a portion from said load and an outlet for discharging an outlet air stream to said load; a direct expansion cooling loop having a direct expansion cooling coil in said flow passage adjacent said inlet for routing said inlet air stream therethrough, said expansion cooling coil having an expansion optimum dew point operating temperature for the exiting air stream from said direct expansion cooling coil above which icing on said direct expansion cooling coil is prevented; first control means interactive with said cooling and dehumidification load for enabling said direct expansion cooling loop for operation when said exiting air stream has a temperature above said expansion optimum dew point, and disabling said direct expansion cooling loop when said exiting air stream has a temperature below said expansion optimum dew point; a chilled liquid cooling loop having a chilled liquid cooling coil in said flow passage downstream of said expansion cooling coil and receiving the exiting air stream therefrom, said chilled liquid cooling coil having a chilled liquid optimum dew point operating temperature for the exiting air stream from said liquid cooling coil above which icing on said chilled liquid cooling coil is prevented; second control means interactive with said cooling and dehumidification load for enabling said chilled liquid cooling loop for operation when the air stream exiting said chilled liquid cooling coil is above said chilled liquid optimum dew point temperature, and disabling said chilled liquid cooling loop when air stream exiting said chilled liquid cooling coil is below said chilled liquid optimum dew point temperature; and a reheat loop including a reheat coil down stream of said chilled liquid coil for raising the temperature of the air stream exiting said chilled liquid cooling coil; and fan means downstream of said reheat coil for delivering a dehumidified and conditioned air stream through said outlet to said load.

3. The cooling and dehumidification system as recited in claim 2 wherein said expansion optimum dew point operating temperature is about 46° F.

4. The cooling and dehumidification system as recited in claim 3 wherein said chilled liquid optimum dew point operating temperature is about 34° F.

5. The cooling and dehumidification system as recited in claim 4 wherein said first control means for reducing cooling in said direct expansion cooling loop as said load approaches said temperature and humidity values.

6. The cooling and dehumidification system as recited in claim 5 wherein said fan means reduces air flow in said flow passage when said direct expansion cooling loop is disabled and said load approaches said temperature and humidity values.

7. The cooling and dehumidification system as recited in claim 6 including third control means for disabling said system when the air stream exiting said fan means has established said temperature and humidity values at said load.

* * * * *